US011415324B2

(12) United States Patent
Song et al.

(10) Patent No.: US 11,415,324 B2
(45) Date of Patent: Aug. 16, 2022

(54) ELECTRIC HEATER

(71) Applicant: LG Electronics Inc., Seoul (KR)

(72) Inventors: Misun Song, Seoul (KR); Changwoo Jeong, Seoul (KR)

(73) Assignee: LG Electronics Inc., Seoul (KR)

( * ) Notice: Subject to any disclaimer, the term of this patent is extended or adjusted under 35 U.S.C. 154(b) by 173 days.

(21) Appl. No.: 16/546,865

(22) Filed: Aug. 21, 2019

(65) Prior Publication Data

US 2020/0063975 A1 Feb. 27, 2020

(30) Foreign Application Priority Data

Aug. 21, 2018 (KR) ..... 10-2018-0097607

(51) Int. Cl.

| | |
|---|---|
| ***H05B 3/02*** | (2006.01) |
| ***F24C 7/08*** | (2006.01) |
| ***F24C 7/06*** | (2006.01) |

(52) U.S. Cl.

CPC ..... *F24C 7/083* (2013.01); *F24C 7/067* (2013.01); *H05B 2203/003* (2013.01); *H05B 2203/005* (2013.01); *H05B 2203/007* (2013.01)

(58) Field of Classification Search

CPC .... F24C 7/067; F24C 7/083; H05B 2203/003; H05B 2203/005; H05B 2203/007; H05B 2203/013; H05B 3/748

USPC ..... 219/443.1–468.2, 478, 542–549

See application file for complete search history.

(56) References Cited

U.S. PATENT DOCUMENTS

| | | | | |
|---|---|---|---|---|
| 3,869,596 | A * | 3/1975 | Howie | H05B 3/26 219/438 |
| 4,286,377 | A * | 9/1981 | Hurko | G01K 7/183 219/448.17 |
| 4,393,299 | A | 7/1983 | McWilliams | |
| 4,763,099 | A | 8/1988 | Balderson | |
| 5,396,047 | A * | 3/1995 | Schilling | G05D 23/1934 219/448.11 |
| 7,417,206 | B2 * | 8/2008 | Nakamura | H01L 21/67103 219/444.1 |

(Continued)

FOREIGN PATENT DOCUMENTS

| | | |
|---|---|---|
| CN | 1203731 | 12/1998 |
| CN | 1533218 | 9/2004 |

(Continued)

OTHER PUBLICATIONS

EP Search Report in European Application No. EP 19192742, dated Jan. 23, 2020, 3 pages.

(Continued)

*Primary Examiner* — Sang Y Paik

(74) *Attorney, Agent, or Firm* — Fish & Richardson P.C.

(57) ABSTRACT

An electric heater includes a substrate, an inner pattern part, and an outer pattern part positioned outside the inner pattern part and spaced apart from the inner pattern part. The inner pattern part includes a plurality of inner tracks spaced apart from each other and a plurality of inner bridges that connect the plurality of inner tracks to each other in series. The outer pattern part includes a plurality of outer tracks spaced apart from each other and a plurality of outer bridges that connect the plurality of outer tracks to each other in series. A length of one or more of the plurality of inner tracks is longer than a length of each of the plurality of the outer tracks.

19 Claims, 7 Drawing Sheets

(56) References Cited

U.S. PATENT DOCUMENTS

| | | | | |
|---|---|---|---|---|
| 8,143,557 | B2 | 3/2012 | Shibata et al. | |
| 9,995,700 | B2 | 6/2018 | Kuemin et al. | |
| 2003/0000937 | A1* | 1/2003 | Ito | H05B 3/143 219/444.1 |
| 2004/0011770 | A1* | 1/2004 | Strang | H01J 37/32724 219/121.36 |
| 2004/0155025 | A1 | 8/2004 | Ito et al. | |
| 2010/0193502 | A1 | 8/2010 | Kim et al. | |
| 2010/0224620 | A1 | 9/2010 | Shibata et al. | |
| 2016/0011134 | A1* | 1/2016 | Kuemin | G01N 27/14 219/448.11 |

FOREIGN PATENT DOCUMENTS

| | | |
|---|---|---|
| CN | 1767149 | 5/2006 |
| CN | 105282879 | 1/2016 |
| CN | 1344482 | 4/2020 |
| DE | 3689830 | 12/1994 |
| DE | 102006022571 | 11/2007 |
| GB | 2322272 | 2/1997 |
| GB | 2321579 | 7/1998 |
| JP | 2005100695 | 4/2005 |
| JP | 2014053574 | 3/2014 |
| KR | 20010083893 | 9/2001 |
| KR | 1020080081360 | 9/2008 |
| KR | 20090009599 | 1/2009 |
| KR | 20090009600 | 1/2009 |
| KR | 101762159 | 8/2017 |
| WO | WO200010364 | 2/2000 |
| WO | WO2007/131852 | 11/2007 |
| WO | WO2009/014333 | 1/2009 |
| WO | WO2019/181500 | 9/2019 |

OTHER PUBLICATIONS

CN Office Action in Chinese Appln. No. 201910769451.4, dated Jun. 2, 2021, 13 pages (with English translation).

Office Action in Chinese Appln. No. 201910769451.4, dated Jan. 29, 2022, 15 pages (with English translation).

* cited by examiner

ELECTRIC HEATER

CROSS-REFERENCE TO RELATED APPLICATIONS

This application claims priority to Korean Patent Application No. 10-2018-0097607 filed on Aug. 21, 2018, in Korea, the entire contents of which are hereby incorporated by reference in their entirety.

FIELD

The present disclosure relates to an electric heater, and more particularly, to an electric heater having a plane heating element.

BACKGROUND

A heater is an apparatus for heating an object. For example, the heater may include an electric heater using Joule heating generated as current flows through a resistance wire or the like. In some cases, an electric heater may generate heat by visible light or infrared light.

In some examples, the electric heater may be installed in a cooking device such as a cooktop stove to heat a food item or a container (hereinafter, referred to as a heating object) by generating heat using electricity. In some cases, the electric heater may use a plane heating element.

In some examples, the plane heating apparatus may include a substrate including a surface made of a material having an electric insulating property, a heating element attached to the surface of the substrate and disposed in a specific shape, and a power supply unit to supply electricity to the heating element.

In some cases, the electric heater may have a temperature distribution of the heating object that varies depending on the shape (or, a pattern) in which the plane heating element is disposed. The plane heating element may be have a pattern or shape for heating the heating object uniformly as much as possible.

In some cases, the plane heating element of the electric heater may include a plurality of track parts having a straight line shape or an arc shape, where adjacent track parts of the plurality of track parts may have a shape in which the adjacent track parts are connected with each other through a bridge part (or track part).

In some examples, the heater may be a temperature sensitive device that includes a heater track made of an electrically conductive material and a pair of electrodes printed on a ceramic coating layer. In some cases, as the current is supplied through the electrode, radiant heat may be generated from the heater track.

SUMMARY

The present disclosure describes an electric heater capable of minimizing dielectric breakdown by uniformly heating the heating object.

According to one aspect of the subject matter described in this application, an electric heater includes a substrate, an inner pattern part that is disposed at a surface of the substrate and that connects between a first starting point and a first ending point, and an outer pattern part that is disposed at the surface of the substrate, that is positioned outside the inner pattern part, and that is spaced apart from the inner pattern part, the outer pattern part connecting between a second starting point and a second ending point. The inner pattern part includes a plurality of inner tracks spaced apart from each other, and a plurality of inner bridges that connect the plurality of inner tracks to each other in series. The outer pattern part includes a plurality of outer tracks spaced apart from each other and a plurality of outer bridges that connect the plurality of outer tracks to each other in series. A length of one or more of the plurality of inner tracks is longer than a length of each of the plurality of the outer tracks.

Implementations according to this aspect may include one or more of the following features. For example, a length of at least one of the plurality of inner tracks may be shorter than the length of each of the plurality of the outer tracks, and a number of the one or more of the plurality of inner tracks may be greater than a number of the at least one of the plurality of inner tracks. In some examples, the inner pattern part may be positioned inside a first imaginary circle, and the outer pattern part may be interposed between the first imaginary circle and a second imaginary circle that is concentric with the first imaginary circle. A diameter of the second imaginary circle may be greater than a diameter of the first imaginary circle.

In some implementations, a width of the outer pattern part along the surface of the substrate may be different from a width of the inner pattern part along the surface of the substrate. In some examples, each of the plurality of inner tracks may have an arc shape, and each of the plurality of outer tracks may have a linear shape. In some examples, each of the plurality of inner tracks and each of the plurality of outer tracks may have a linear shape.

In some implementations, each of the plurality of outer tracks may extend in a radial direction of the outer pattern part. In some examples, the plurality of outer tracks may extend parallel to each other. In some examples, each of the plurality of outer tracks may have an inner end facing the plurality of inner tracks and an outer end disposed outward of the inner end. The electric heater may further include a pair of first electrode parts connected to the outer pattern part, and a pair of second electrode parts connected to the inner pattern part, where each of the pair of first electrode parts is connected to the outer end or the inner end of one of the plurality of outer tracks.

In some examples, the plurality of outer bridges may include a first outer bridge that connects the outer ends of adjacent outer tracks of the plurality of outer tracks to each other and a second outer bridge that connects the inner ends of adjacent outer tracks of the plurality of outer tracks to each other. In some examples, the first outer bridge and the second outer bridge may be arranged alternately along a circumferential direction of the outer pattern part. The first outer bridge may have a curved shape that protrudes outward to the outer end, and the second outer bridge may have a curved shape that protrudes inward to the inner end.

In some examples, a length of the first outer bridge between the outer ends of the adjacent outer tracks may be greater than a length of the second outer bridge between the inner ends of the adjacent outer tracks.

In some implementations, the plurality of inner tracks may include an outermost inner track, an innermost inner track positioned radially inside the outermost inner track, and an intermediate inner track interposed between the outermost inner track and the innermost inner track. The outermost inner track, the innermost inner track, and the intermediate inner track may have concentric arc shapes.

In some implementations, the plurality of inner tracks may include a first inner track that is disposed at a first side or a second side opposite to the first side with respect to an imaginary center line passing through a center of the inner pattern part, and a second inner track that crosses the imaginary center line and extends between the first side and the second side. The first inner track and the second inner may track extend parallel to each other.

In some implementations, the plurality of inner tracks may extend parallel to each other and cross an imaginary center line passing through a center of the inner pattern part. In some implementations, each of the plurality of outer tracks and each of the plurality of the inner tracks may extend parallel to each other.

According to another aspect, an electric heater includes a substrate, an inner pattern part disposed at a surface of the substrate, and an outer pattern part disposed at the surface of the substrate and positioned outside the inner pattern part. The inner pattern part includes a plurality of inner tracks that are spaced apart from each other and that have an arc shape, and a plurality of inner bridges that connect the plurality of inner tracks to each other in series. The outer pattern part include a plurality of outer tracks that are spaced apart from each other and that have a linear shape, and a plurality of outer bridges that connect the plurality of outer tracks to each other.

Implementations according to this aspect may include one or more of the following features or the features described above. For example, the plurality of outer tracks may extend in radial directions of the outer pattern part or extend parallel to each other.

According to another aspect, an electric heater includes a substrate, an inner pattern part disposed at a surface of the substrate, and an outer pattern part disposed at the surface of the substrate and positioned outside the inner pattern part. The inner pattern part includes a plurality of inner tracks spaced apart from each other, and a plurality of inner bridges that connect the plurality of inner tracks to each other in series. The outer pattern part include a plurality of outer tracks spaced apart from each other, and a plurality of outer bridges that connect the plurality of outer tracks to each other. Each of the plurality of inner tracks and each of the plurality of outer tracks have a linear shape.

Implementations according to this aspect may include one or more of the following features or the features described above. For example, the plurality of outer tracks may extend in radial directions of the outer pattern part or extend parallel to each other.

In some implementations, in the electric heater, at least some of the plurality of inner tracks may extend longer than the outer track. Accordingly, the length of the outer track may become relatively shorter. Accordingly, the potential difference between adjacent outer tracks may be reduced, and the risk of the dielectric breakdown may be reduced.

In some implementations, the outer track has a straight line shape, so the length of the outer track may become relatively shorter in comparison to an outer track having an arch shape. Accordingly, the potential difference between adjacent outer tracks may be reduced and the risk of the dielectric breakdown may be reduced.

In some implementations, the inner track, which is a heating part of the inner pattern part, may have a length longer than the length of the outer track which is a heating part of the outer pattern part. The electric heater may have the higher heating effect in the inner pattern part in a simpler structure.

In some implementations, the number of inner tracks, which is longer than the outer track, of the plurality of inner tracks is larger than the number of inner tracks, which is shorter than the outer track, of the plurality of inner tracks. Accordingly, the heating effect of the inner pattern part may be relatively increased.

DETAILED DESCRIPTION

Hereinafter, one or more detailed implementations of the present disclosure will be described in detail with reference to accompanying drawings.

Figure 1:
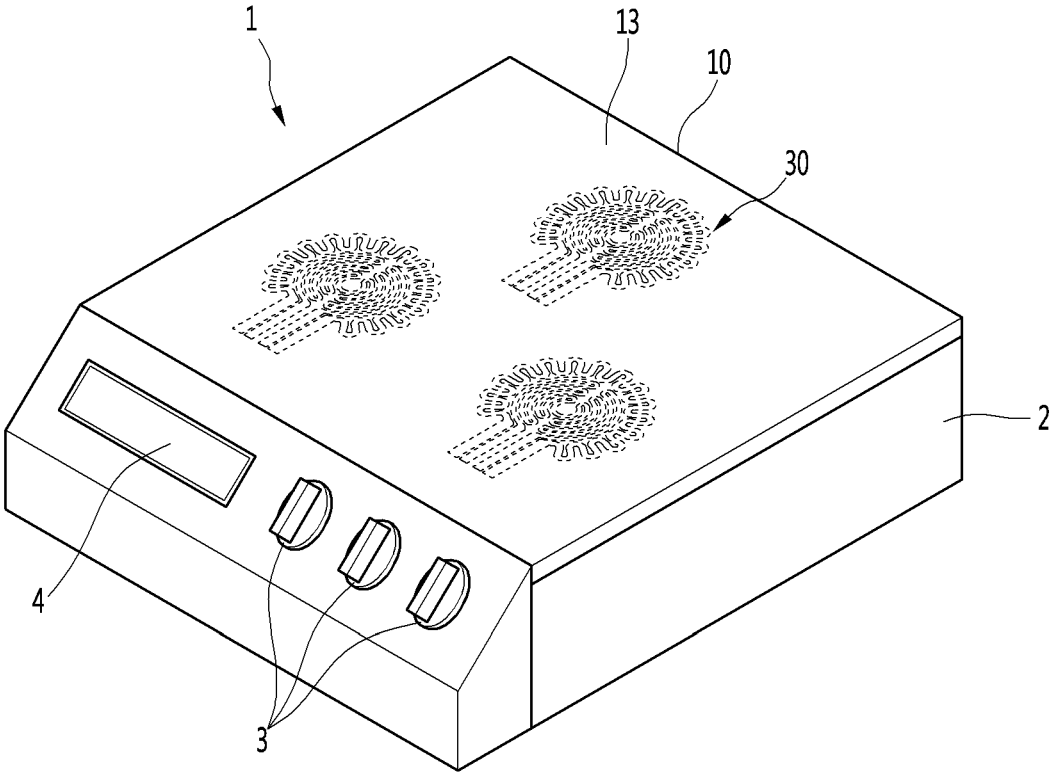
FIG. 1 is a perspective view showing an example of an electric range including an electric heater.
Figure 2:
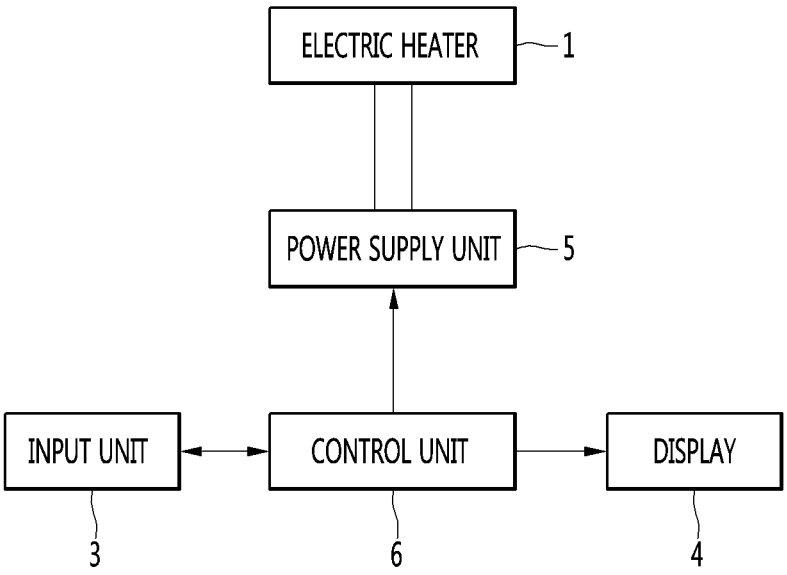
FIG. 2 is a control block diagram of an example electric range including an electric heater.

FIG. 1 is a perspective view showing an example of an electric range including an electric heater, and FIG. 2 is a control block diagram of an example of an electric range including an electric heater.

In some implementations, an electric heater 1 may include some of an electric range (hereinafter, referred to as "electric range"), such as cooktop stove.

In some examples, the electric range may include a cabinet 2 that defines at least a portion of an outer appearance of the electric range. For example, the cabinet 2 may define side surfaces, a bottom surface, and a front surface of the electric range. The electric heater 1 may be disposed at an upper part of the cabinet 2. The cabinet 2 may have an open top surface, and the electric heater 1 may be disposed in the cabinet 2. For example, the electric heater 1 may be disposed at the upper part of the cabinet 2 and close the open top surface of the cabinet 2.

The electric range may include an input unit 3 to manipulate the electric range, and a display 4 to display various pieces of information such as information of the electric range. In addition, the electric range may further include a power supply unit 5 connected with the electric heater 1 to apply a current or a voltage to the electric heater 1. The electric range may further include a control unit 6 to control the power supply unit 5 and the display 4 according to input from the input of the input unit 3.

For example, the input unit 3 may include a rotary knob, a button, or a touch input device including a pressure sensor. The input unit 3 may be disposed at a front surface of the electric heater 1. The display 4 may include a liquid crystal display (LCD), light emitting diode display (LED), a light indicator, a 7-segment display, or the like. The display 4 may be disposed at the front surface of the electric heater 1. The control unit 6 may include an electric device, an electric circuit, a processor (e.g., a microprocessor), an integrated circuit, etc. The control unit 6 may be disposed in the cabinet 2. In some cases, the control unit may be disposed outside the cabinet 2 and configured to communicate with the input unit 3 and the display 4.

In some implementations, the electric heater 1 may be installed in the cabinet 2 such that a top surface of the electric heater 1 is exposed to the outside. The heating object to be heated by the electric range may be placed on the top surface of the electric heater 1, and the top surface of the electric heater 1 may be a heating object seating surface on which the heating object is seated.

Figure 3:
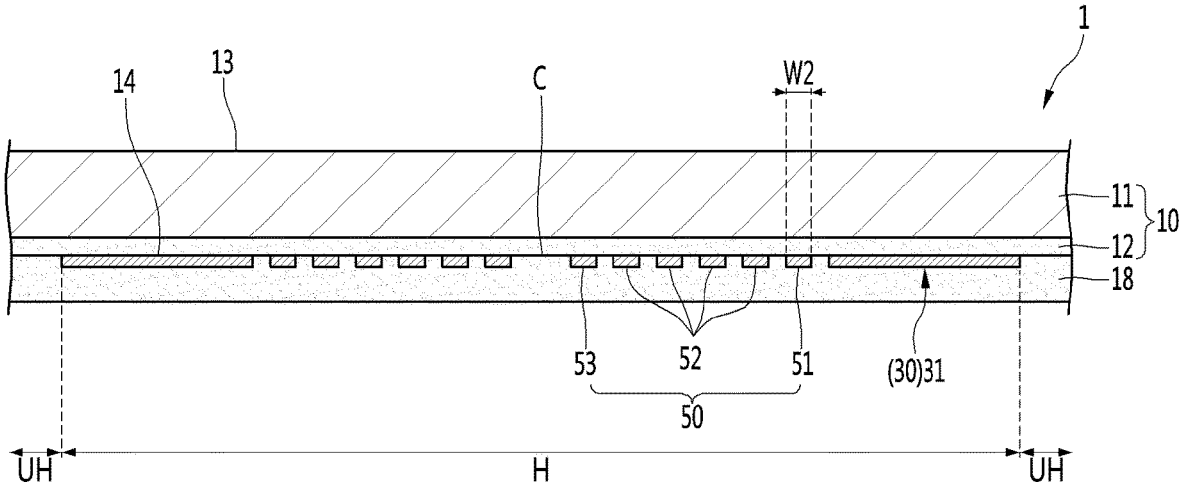
FIG. 3 is a bottom view illustrating an example of an electric heater.

FIG. 3 is a cross-sectional view illustrating an example of an electric heater.

The electric heater 1 may include a substrate 10 and a first plane heating element 30 disposed on one surface of the substrate 10. For example, the first plane heating element 30 may be disposed on a bottom surface of the substrate 10. In some cases, the first plane heating element 30 may be disposed on a top surface of the substrate 10.

In some implementations, the substrate 10 may be an insulating substrate capable of forming a conductor pattern on the surface of the substrate 10. The top surface of the substrate 10 may be the heating object seating surface 13 on which the heating object is placed. The bottom surface of the substrate 10 may be a plane heating element forming surface 14 on which the first plane heating element 30 and a second plane heating element 50 to be described.

In some implementations, the substrate 10 may include only the base 11 made of an insulating material in the entire portion thereof. In some implementations, the substrate 10 may include the base 11 made of an insulating material or a non-insulating material and an insulating layer 12 disposed on one surface of the base 11.

The base 11 may include glass, and the insulating layer 12 may be formed through coating or printing for the bottom surface of the glass.

In some implementations, the first plane heating element 30 may be directly formed on one surface of the base 11 including the insulating material. In some implementations, the insulating layer 12 may be disposed on the base 11, and the first plane heating element 30 may be disposed on the insulating layer 12. That is, the insulating layer 12 may be disposed between the base 11 and the first plane heating element 30.

The base 11 may be formed in the shape of a plate on which the heating object is placed, and may be formed in the shape of a container in which the heating object may be received.

The insulating layer 12 may be formed on the bottom surface of the base 11. The insulating layer 12 may be formed on the entire portion of the bottom surface of the base 11 or only some of the bottom surface of the base 11. Alternatively, the insulating layer 12 may be formed only on an area for forming the first plane heating element 30 and the second plane heating element 50 to be described. The insulating layer 12 may constitute the entire portion of the bottom surface of the substrate 10 or constitute some of the bottom surface of the substrate 10.

The first plane heating element 30 may be formed on the bottom surface 14 of the insulating layer 12. The first plane heating element 30 and the second plane heating element 50 may have the size smaller than the size of the substrate 10. The bottom surface of the substrate 10 may include (i) a heating area H that includes the first plane heating element 30 and the second plane heating element 50, and (ii) a non-heating area UH around the heating area H.

In some implementations, the electric heater 1 may further include a coating layer 18 surrounding the first plane heating element 30 and the second plane heating element 50. The coating layer 18 may be formed of an electrically insulating material and may protect the first plane heating element 30 and the second plane heating element 50.

In some implementations, the substrate 10 may include a flexible material, for example, a flexible insulating film. In this case, the electric heater 1 may be a flexible plane heater. It may be understood that such a flexible plane heater is attached to a member, on which the heating object is placed, to heat the heating object, which is similar to the top surface of the electric range.

Figure 4:
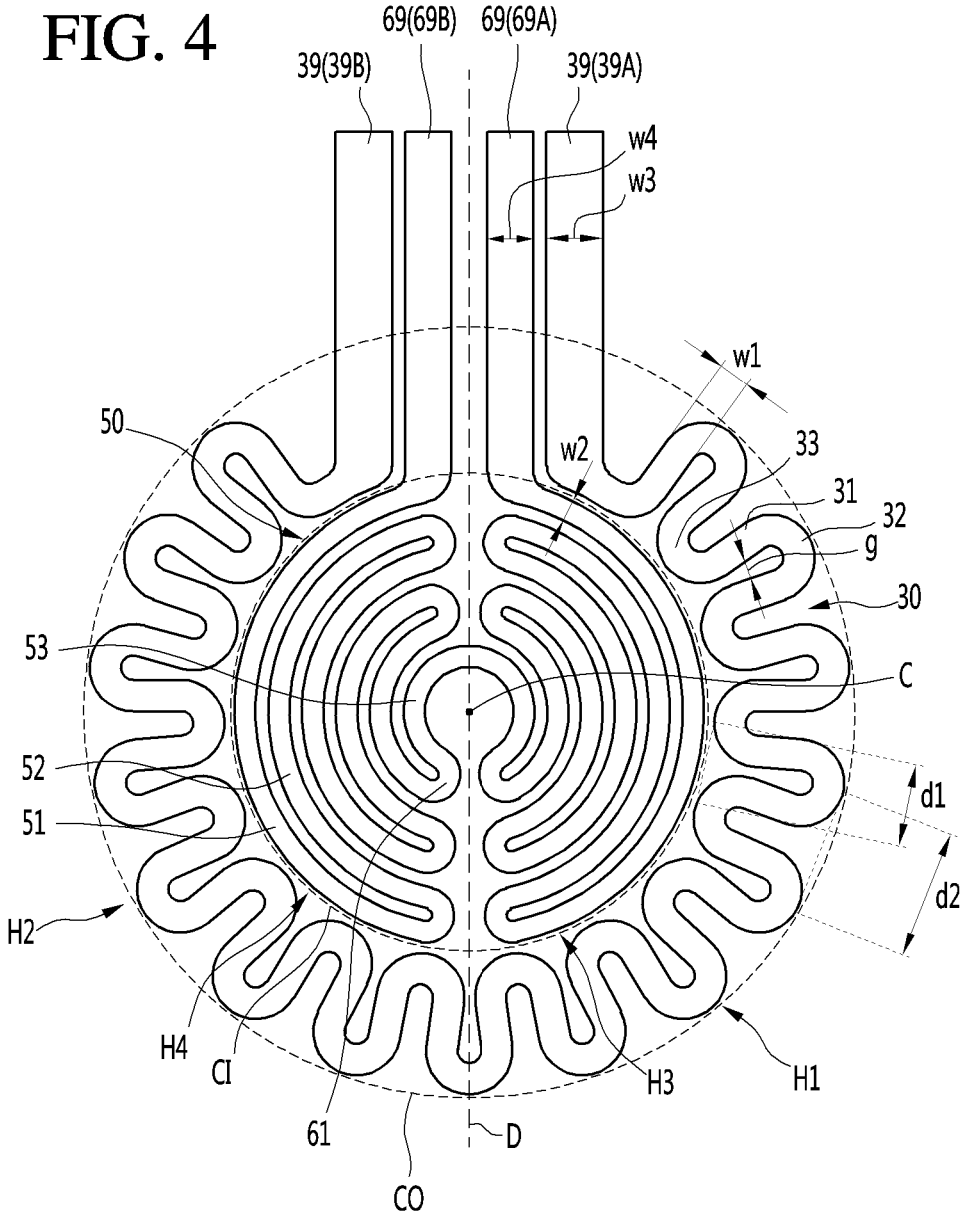
FIG. 4 is a bottom view illustrating the electric heater of FIG. 3.

FIG. 4 is a bottom view illustrating an example of an electric heater.

In the following description of the present disclosure, an inward direction may be defined as a direction facing a center of the first plane heating element 30 and the second plane heating element 50, and an outward direction may be defined as a direction opposite to the inward direction. The centers of the first plane heating element 30 and the second plane heating element 50 may be the centers of a first imaginary circle CI and a second imaginary circle CO.

The first plane heating element 30 may be disposed outside the second plane heating element 50. In more detail, hereinafter, the first plane heating element 30 will be referred to as an outer plane heating element 30 and the second plane heating element 50 will be referred to an inner plane heating element 50.

In some implementations, the outer plane heating element 30 may include outer pattern parts 31, 32, and 33 to heat the heating object uniformly as much as possible and a first electrode part 39 connected with the outer pattern parts 31, 32, and 33.

The outer pattern parts 31, 32, and 33 may connect a starting point with an ending point thereof. According to the present implementation, the starting point and the ending point of the outer pattern parts 31, 32, and 33 may refer to parts, which are connected with a pair of first electrode parts 39, of the outer pattern parts 31, 32, and 33.

The outer pattern parts 31, 32, and 33 may be positioned between the first imaginary circle CI and the second imaginary circle CO. The first imaginary circle CI and the second imaginary circle CO may be concentric. The radius of the second virtual circle CO may be larger than the radius of the first virtual circle CI. Inner pattern parts 51, 52, 53, and 61 to be described later may be positioned inside the first imaginary circle CI.

An area between the first imaginary circle CI and the second imaginary circle CO may be referred to as an outer area and an area inside the first imaginary circle CI may be named as an inner area. In this case, the inner pattern parts 51, 52, 53, and 61 may be positioned in the inner area, and the outer pattern parts 31, 32, and 33 may be positioned in the outer area.

The outer pattern parts 31, 32, and 33 may include a plurality of outer tracks 31 and a plurality of outer bridges 32 and 33 for connecting the plurality of outer tracks 31 with each other in series.

Each outer track 31 may have a straight line shape. The straight line shape may be a bar shape.

In more detail, each outer track 31 may longitudinally extend in a radial direction of the outer pattern parts 31, 32, and 33. The radial direction of the outer pattern parts 31, 32, and 33 may refer to a radial direction of the second imaginary circle CO.

The plurality of outer tracks 31 may have equal lengths. The plurality of outer tracks 31 may have equal widths W1.

The plurality of outer tracks 31 may be spaced apart from each other. More specifically, the plurality of outer tracks 31 may be arranged at regular distances while being spaced apart from each other, in a circumferential direction of the outer pattern parts 31, 32, and 33. The circumferential direction of the outer pattern parts 31, 32, and 33 may be a circumferential direction of the second imaginary circle CO. The gap "g" between adjacent outer tracks 31 may be increased in the outward direction.

Accordingly, the length of each outer track 31 may be relatively reduced, and the potential difference between adjacent outer tracks 31 may be relatively reduced when compared to the case that the outer track 31 has the shape of an arc extending in the circumferential direction, similarly to the inner tracks 51, 52, and 53 to be described. Accordingly, the risk of dielectric breakdown may be minimized. In some implementations, the lengths of the inner tracks 51, 52, and 53 may be relatively reduced, when compared to the case that the outer track 31 has the shape of an arc extending in the circumferential direction, similarly to the inner tracks 51, 52, and 53 to be described. Accordingly, the potential difference between adjacent inner tracks of the inner tracks 51, 52, and 53 is not excessively great, and In some implementations, the plurality of outer bridges 32 and 33 may connect the plurality of outer tracks 31 in series in a flow direction of a current.

The plurality of outer bridges 32 and 33 may be spaced apart from each other.

The outer bridges 32 and 33 may be larger than the inner bridges 61 to be described later.

In some implementations, the widths of the outer bridges 32 and 33 may be equal to the width W1 of the outer track 31. However, the present disclosure is not limited thereto. For example, the widths of the outer bridges 32 and 33 may be formed to be narrower than the width W1 of the outer track.

In some implementations, a width of a portion of the outer pattern parts 31, 32, and 33 defined along the surface of the substrate 10 is different from a width of a portion of the inner pattern part 51, 52, 53, and 61 defined along the surface of the substrate 10.

In some implementations, to minimize local heating caused due to the difference in path between inner circumferences and outer circumferences of the outer bridges 32 and 33, thicknesses of the outer bridges 32 and 33 in an up-down direction may be thicker than the thickness of the outer track 31 in an up-down direction. Accordingly, the sectional areas of the outer bridges 32 and 33 may be larger than the sectional area of the outer track 31 and the difference in resistance, which is caused due to the difference in path, may be reduced, thereby reducing the local heating. To this end, the outer bridges 32 and 33 may be manufactured through a process of over-coating after a printing process with the same thickness as that of the outer track 31 or through at least two printing processes. However, the process method is not limited thereto.

An amount of heat generated by each of the outer bridges 32 and 33 may be smaller than an amount of heat generated by the outer track 31. The temperature of each of the outer bridges 32 and 33 may be lower than the temperature of each of the outer tracks 31. In other words, the outer track 31 may be a main heating part of the outer pattern parts 31, 32, and 33, and the outer bridges 32 and 33 may be a sub-heating part of the outer pattern parts 31, 32, and 33.

The plurality of outer bridges 32 and 33 may include a first outer bridge 32 and a second outer bridge 33.

Each of the first outer bridges 32 may connect outer ends of the adjacent outer tracks 31 with each other. The second outer bridges 33 may connect inner ends of the adjacent outer tracks 31 with each other. The outer end of each outer track 31 may be closer to the second imaginary circle CO of the first imaginary circle CI and the second imaginary circle CO. The inner end of each outer track 31 may be closer to the first imaginary circle CI of the first imaginary circle CI and the second imaginary circle CO.

The first outer bridge 32 and the second outer bridge 33 may be arranged alternately in the circumferential direction of the outer pattern parts 31, 32, and 33. In other words, the outer pattern parts 31, 32, and 33 may be formed in a zigzag shape. Accordingly, an area, which is occupied by the outer pattern parts 31, 32, and 33, of the limited outer area may be wider, and the efficiency of the outer plane heating element 30 may be improved.

The first outer bridge 32 may have a curved shape. In more detail, the first outer bridge 32 may have an arc shape. The first outer bridge 32 may be curved to protrude in the outward direction. In other words, the first outer bridge 32 may be curved toward the second imaginary circle CO.

The second outer bridge 33 may have a curved shape. In more detail, the second outer bridge 33 may have an arc shape. The second outer bridge 33 may be curved to protrude in the inward direction. In other words, the second outer bridge 33 may be curved toward the first imaginary circle CI.

The length of the first outer bridge 32 may be longer than the length of the second outer bridge 33.

The second outer bridges 33 may be spaced apart from the inner pattern parts 51, 52, 53, and 61 to be described later. In more detail, the second outer bridge 33 may be spaced apart from the outermost inner track 51 in the radial direction of the outer pattern parts 31, 32, and 33.

The distance d1 between the second outer bridges 33 adjacent to each other may be shorter than the distance d2 between the first outer bridges 32 adjacent to each other. More specifically, the distance d1 between the innermost points of the adjacent second outer bridge 33 may be shorter than the distance d2 between the outermost points of the adjacent first outer bridges 32.

In some implementations, the outer plane heating element 30 may further include a pair of first electrode parts 39 connected with the outer pattern parts 31, 32, and 33. The first electrode part 39 may be directly connected with the outer pattern parts 31, 32, and 33 or may be connected with the outer pattern parts 31, 32, and 33 through a connector.

The pair of first electrode parts 39 may include a positive electrode part 39A and a negative electrode part 39B. One of the positive electrode part 39A and the negative electrode part 39B may be connected with the starting point of the outer pattern parts 31, 32, and 33 and a remaining one may be connected with the ending point of the outer pattern parts 31 and 32 33, respectively.

The starting point of the outer pattern parts 31, 32, and 33 may be positioned at an inner end of one outer track 31 and the ending point of the outer pattern parts 31, 32, and 33 may be positioned at an inner end of an opposite outer track 31. In other words, the pair of first electrode parts 39 may be connected with the inner ends of the one outer track 31 and the opposite outer track 31, respectively.

In this case, at least a portion of each first electrode part 39 may be interposed between the one outer track 31 and the opposite outer track 31 in the circumferential direction of the outer pattern parts 31, 32, and 33. The first electrode parts 39 may be spaced apart from the first outer bridges 32 connected with the one outer track 31 and the opposite outer track 31, respectively.

The width W3 of the first electrode part 39 may be wider than the width W4 of the outer track 31.

In some implementations, the outer plane heating element 30 may have a symmetrical shape about an imaginary center line D extending across the outer plane heating element 30. Here, the imaginary center line D may be an imaginary straight line passing through the center C of the outer plane heating element 30.

The outer plane heating element 30 may have a symmetrical structure about the imaginary center line D. In more detail, the outer pattern parts 31, 32, and 33 include a first outer pattern part H1 and a second outer pattern part H2 positioned opposite to each other about the imaginary center line D. The first outer pattern part H1 and the second outer pattern part H2 may have shapes symmetrical to each other about the imaginary center line D. In addition, the pair of first electrode parts 39 may be positioned opposite to each other about the imaginary center line D.

In some implementations, the inner plane heating element 50 may be positioned inside the outer plane heating element 30. The inner plane heating element 50 may generate heat independently of the outer plane heating element 30. The inner plane heating element 50 may be spaced apart from the outer plane heating element 30.

The electric heater 1 may be controlled in a single heating mode in which a current is applied to only one of the outer plane heating element 30 and the inner plane heating element 50 or may be controlled in a dual heating mode in which a current is applied to both the outer plane heating element 30 and the inner plane heating element 50.

For example, when the area of a part, which is seated on the substrate 10, is narrower, the electric heater 1 may apply a current only to the inner plane heating element 50 and not to the outer plane heating element 30. In contrast, when the area of a part, which is seated on the substrate 10, is wider, the electric heater 1 may apply a current to each of the inner plane heating element 50 and the outer plane heating element 30.

The inner plane heating element 50 may include the inner pattern parts 51, 52, 53, and 61 which are capable of heating the heating object uniformly as much as possible and a second electrode part 69 connected with the inner pattern parts 51, 52, 53, and 61.

The inner pattern parts 51, 52, 53, and 61 may connect the starting point and the ending point with each other. According to the present implementation, the starting and ending points of the inner pattern parts 51, 52, 53, and 61 may refer to parts, which are connected with a pair of second electrode parts 69, of the inner pattern parts 51, 52, 53, and 61.

The inner pattern parts 51, 52, 53, and 61 may be positioned inside the first imaginary circle CI. In other words, the inner pattern parts 51, 52, 53, and 61 may be positioned in the inner area, which refers to an area inside the first imaginary circle CI.

The inner pattern parts 51, 52, 53, and 61 may include a plurality of inner tracks 51, 52, and 53 which gradually decrease toward the inside and a plurality of inner tracks 51, and a plurality of inner bridges 61 to connect the inner tracks 51, 52, and 53 with each other in series.

The inner tracks 51, 52, and 53 may have curved shapes. In more detail, the inner tracks 51, 52, and 53 may be arc-shaped extending in the circumferential direction of the inner pattern parts 51, 52, 53, and 61, and may be formed to have the same center C. The circumferential direction of the inner pattern parts 51, 52, 53, and 61 may refer to the circumferential direction of the first imaginary circle CI. The center of each of the inner tracks 51, 52, and 53 may coincide with the center C of the first imaginary circle CI.

Each of the inner tracks 51, 52, and 53 may have any one of a major arc shape having the center angle of more than 180 degrees, a semicircular shape, and a minor arc shape having the central angle of less than 180 degrees. Each of the inner tracks 51, 52, and 53 may have the combination of at least two of the major arc shape, the semicircular shape, and the minor arc shape.

The plurality of inner tracks 51, 52, and 53 may have lengths gradually reduced toward the inside thereof. The widths W2 of the plurality of inner tracks 51, 52, and 53 may be equal to each other.

The widths W2 of the inner tracks 51, 52, and 53 may be different from the width W1 of the outer track 31. The width W2 of the inner tracks 51, 52, and 53 may become narrower than the width W1 of the outer track 31.

The plurality of inner tracks 51, 52, and 53 may be spaced apart from each other. In more detail, the plurality of inner tracks 51, 52, and 53 may be spaced apart from each other in the radial direction of the inner pattern parts 51, 52, 53, and 61. The radial direction of the inner pattern parts 51, 52, 53, and 61 may refer to the radial direction of the first imaginary circle CI. The gaps between the adjacent inner tracks of the inner tracks 51, 52, and 53 may equal to each other.

The plurality of inner tracks 51, 52, and 53 may include an outermost inner track 51, an intermediate inner track 52, and an innermost inner track 53.

The intermediate inner track 52 may be interposed between the outermost inner track 51 and the innermost inner track 53 in the radial direction.

In some implementations, the outermost inner tracks 51 may be paired. At least a pair of intermediate inner tracks may be provided. The innermost inner track 53 may be provided as one inner track.

The length of the outermost inner track 51 may be longer than the length of the intermediate inner track 52. The length of the intermediate inner track 52 may be longer than the length of the innermost inner track 53. The length of each of the plurality of intermediate inner tracks 52 may be relatively increased as the intermediate inner tracks are gradually adjacent to the outermost inner track 51 and may be relatively decreased as the intermediate tracks are gradually adjacent to the innermost inner track 53.

The outermost inner track 51 may be spaced apart from the second outer bridge 33 in the radial direction.

In some implementations, the plurality of inner bridges 61 may connect the plurality of inner tracks 51, 52, and 53 with each other in series in a flow direction of a current.

The plurality of inner bridges 61 may be spaced apart from each other.

The inner bridges 61 may be smaller than the outer bridges 32 and 33.

The width of the inner bridge 61 may be equal to the width W2 of the inner tracks 51, 52, and 53. However, the present disclosure is not limited thereto. For example, the width of the inner bridge 61 may be narrower than the width W2 of the inner tracks 51, 52, and 53.

In addition, to minimize the local heat generated due to the path difference between an inner circumference and an outer circumference of each inner bridge 61, the up-down direction of the inner bridge 61 may be thicker than the up-down thicknesses of the inner tracks 51, 52, and 53. Accordingly, the sectional area of the inner bridge 61 may become wider than the sectional area of the inner tracks 51, 52, and 53, and the resistance difference resulting from the path difference may be reduced to reduce the local heat. To this end, the inner bridge 61 may be manufactured through a process of over-coating after a printing process with the same thickness as that of the inner tracks 51, 52, 53 or through at least two printing processes. However, the process scheme is not limited thereto.

The heating value of each inner bridge 61 may be less than the heating value of each of the inner tracks 51, 52, and 53. The temperature of each inner bridge 61 may be lower than the temperature of each of the inner tracks 51, 52, and 53. In other words, the inner tracks 51, 52, and 53 may be main heating parts of the inner pattern parts 51, 52, 53, and 61, and the inner bridges 61 may be sub-heating parts of the inner pattern parts 51, 52, 53, and 61.

In some implementations, the inner plane heating element may further include a pair of second electrode parts 69 connected with the inner pattern parts 51, 52, 53, and 61. The second electrode part 69 may be directly connected with the inner pattern parts 51, 52, 53, and 61 or may be connected with the inner pattern parts 51, 52, 53, and 61 by a connector.

The pair of second electrode parts 69 may include a positive electrode part 69A and a negative electrode part 69B. One of the positive electrode part 69A and the negative electrode part 69B may be connected with the starting point of the inner pattern parts 51, 52, 53, and 61, and a remaining one of the positive electrode part 69A and the negative electrode part 69B may be connected with the ending point of the inner pattern parts 51, 52, 53, and 61, respectively.

According to the present implementation, the starting point of the inner pattern parts 51, 52, 53, and 61 may be positioned at an end of one outermost inner track 51 and the ending point of the inner pattern parts 51, 52, 53, and 61 may be positioned at an end of an opposite outer inner track 51. In other words, the pair of second electrode parts 69 may be connected with the one outermost inner track 51 and the opposite outermost inner track 51, respectively.

In this case, at least a portion of each second electrode part 69 may be interposed between the pair of first electrode parts 39. In addition, each second electrode part 69 may be spaced apart from the inner bridge 61.

The width W4 of the second electrode part 69 may be wider than the widths W2 of the inner tracks 51, 52, and 53.

In some implementations, the inner plane heating element 50 may have a symmetrical shape about an imaginary center line D extending across the inner plane heating element 50. Here, the imaginary center line D may be an imaginary straight line passing through the center C of the inner plane heating element 50.

The inner plane heating element 50 may have a symmetrical structure about the imaginary center line D. In more detail, the inner pattern parts 51, 52, 53, and 61 include a first inner pattern part H3 and a second inner pattern part H4 positioned opposite to each other about the imaginary center line D. The first inner pattern part H3 and the second inner pattern part H4 may have shapes symmetrical to each other about the imaginary center line D.

In addition, the pair of outermost inner parts 51 may be positioned opposite to each other about the imaginary center line D. In addition, the pair of intermediate inner tracks 52 having the same curvature may be positioned opposite to each other about the imaginary center line D. The innermost inner track 53 may cross the imaginary center line D. The inner bridge 61 may be curved while protruding toward the imaginary center line D.

In addition, the pair of second electrode parts 69 may be positioned opposite to each other about the imaginary center line D.

In some implementations, at least some of the plurality of inner tracks 51, 52, and 53 may be longer than the outer track 31. In more detail, at least some of the plurality of inner tracks 51, 52, and 53 may be formed to be longer than the longest outer track 31 among the plurality of outer tracks 31.

In addition, the number of inner tracks 51, 52, and 53, which are longer than the outer track 31, among the plurality of inner tracks 51, 52, and 53 is greater than the number of the inner tracks 51, 52, and 53, which is shorter than the outer track 31, among the inner track 51, 52, and 53 In this case, it is obvious that the number of the inner tracks 51, 52, and 53, which is shorter than the outer track 31, among the plurality of inner tracks 51, 52, and 53 may be zero.

As described above, the main heat generating parts of the inner pattern parts 51, 52, 53, and 61 may be the inner tracks 51, 52, and 53, and the main heating part of the outer pattern parts 31, 32, and 33 may be the outer track 31. That is, at least some of the plurality of inner tracks 51, 52, and 53 is formed to be longer than the plurality of outer tracks 31, thereby implementing the electric heater 1 having more excellent heating effect of the inner pattern parts 51, 52, 53, and 61 in the simple structure.

Figure 5:
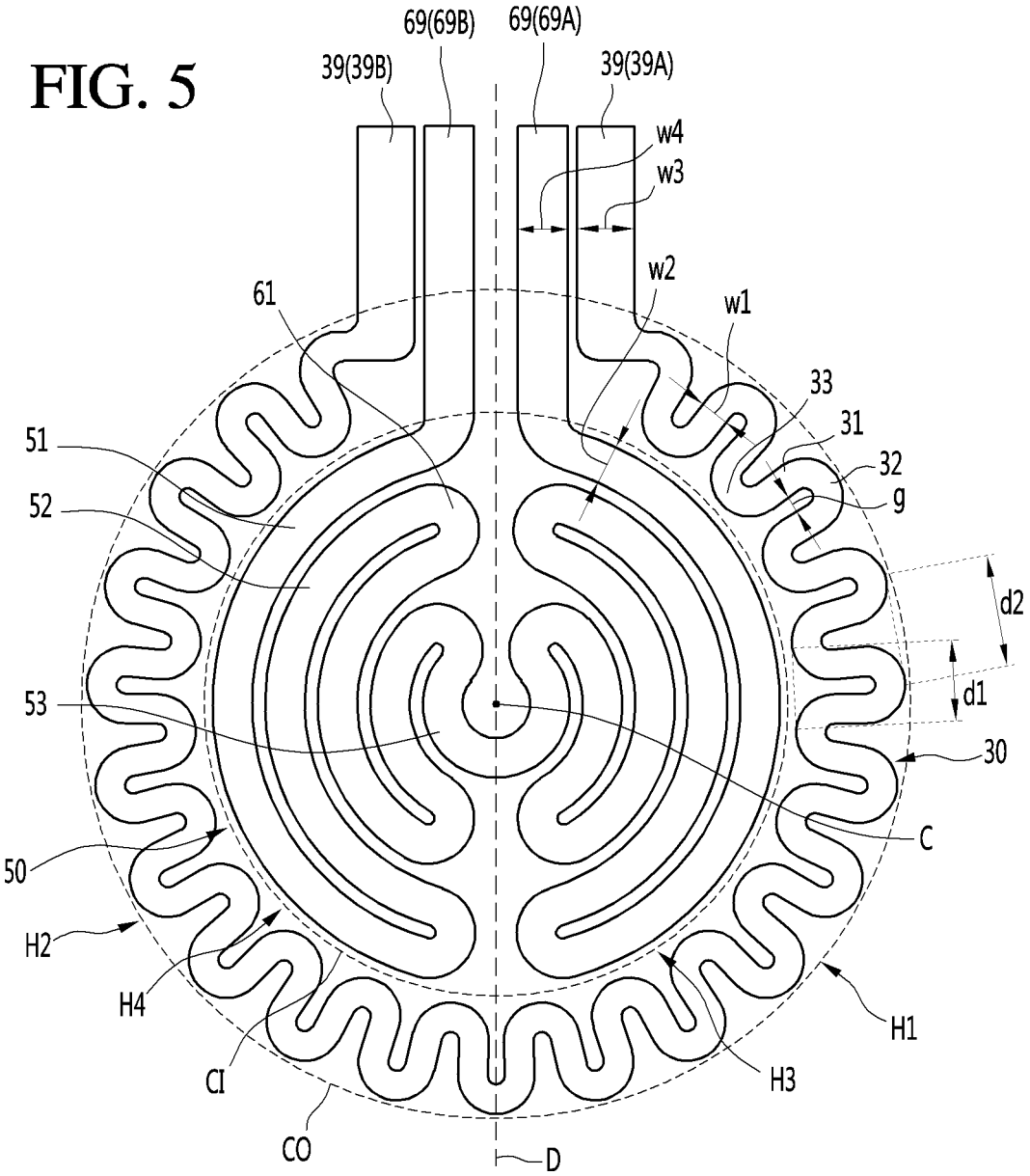
FIG. 5 is a bottom view illustrating an example of an electric heater.

FIG. 5 is a bottom view illustrating an example of an electric heater.

Hereinafter, the redundant repeat of the first implementation described above will be omitted, and the following description will be made while focusing on the difference.

In some implementations, the width W1 of the outer track 31 may be narrower than the widths W2 of the inner tracks 51, 52, and 53.

The starting point of the outer pattern parts 31, 32, and 33 may be positioned at an outer end of one outer track 31 and the ending point of the outer pattern parts 31, 32, and 33 may be positioned at an outer end of another outer track 31. In other words, the pair of first electrode parts 39 may be connected with the outer ends of the one outer track 31 and another outer track 31, respectively.

For example, each of the plurality of outer tracks 31 may have an inner end facing the plurality of inner tracks 51 and an outer end disposed outward of the inner end. In some implementations, each of the pair of first electrode parts 39 is connected to the outer end of one of the plurality of outer tracks. In some implementations, each of the pair of first electrode parts 39 is connected to the inner end of one of the plurality of outer tracks.

Figure 6:
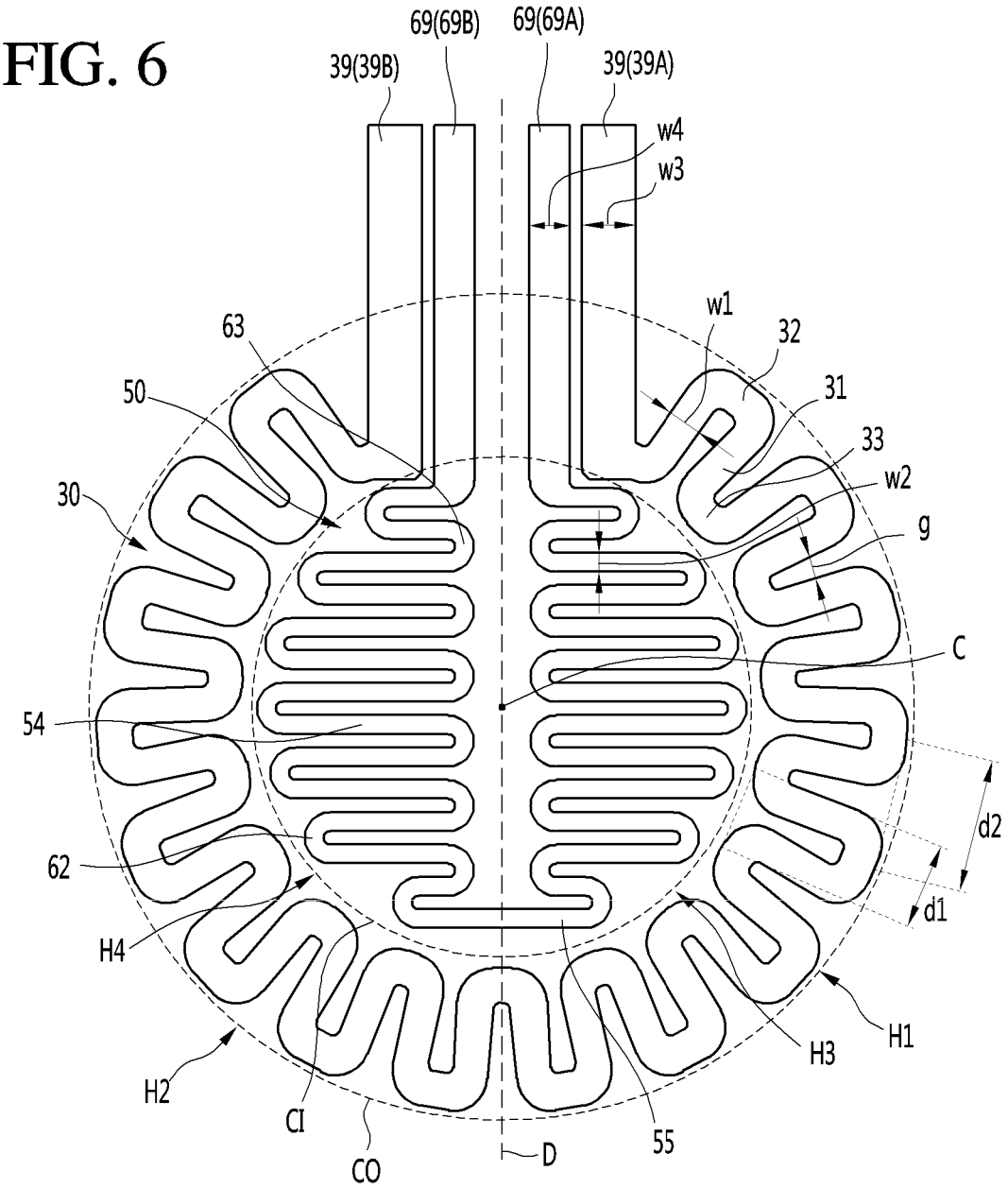
FIG. 6 is a bottom view illustrating an example of an electric heater.

FIG. 6 is a bottom view illustrating an example of an electric heater.

Hereinafter, the redundant repeat of the first implementation described above will be omitted, and the following description will be made while focusing on the difference.

An inner plane heating element 50 according to the present implementation may include inner pattern parts 54, 55, 62, and 63.

The inner pattern parts 54, 55, 62 and 63 have a plurality of inner tracks 54 and 55 formed in parallel with each other and inner bridges 62 and 63 connected with the plurality of inner tracks 54 and 55 in series.

The inner tracks 54 and 55 may have a straight line shape. The straight line shape may be a bar shape.

In more detail, the inner tracks 54 and 55 may extend in one direction. The one direction may be a direction perpendicular to the imaginary center line D extending across the inner plane heating element 50, but is not limited thereto Hereinafter, the longitudinal direction of the inner tracks 54 and 55 will be referred to as a first direction (a left-right direction in FIG. 6) and the direction perpendicular to the first direction will be referred to as a second direction (an up-down direction in FIG. 6).

A plurality of inner tracks 54 and 55 may be spaced apart from each other. In more detail, the plurality of inner tracks 54 and 55 may be spaced apart from each other in the second direction.

The plurality of inner tracks 54 and 55 may include a first inner track 54 positioned at one side or an opposite of the imaginary center line D and a second inner track 55 crossing the center line.

At least a pair of first inner tracks 54 may be provided. The second inner track 55 may be one.

At least some of the plurality of first inner tracks 54 may have different lengths. The length of each of the plurality of first inner tracks 54 may be longer as the plurality of first inner tracks 54 are closer to the center C of the inner plane heating element 50 in the second direction.

The second inner track 55 is shorter than the longest first inner track 54 among the plurality of first inner tracks 54 and the shortest inner track 54 of the plurality of first inner tracks 54.

The pair of first inner tracks 54 positioned on the straight line in the first direction may be positioned opposite to each other about the imaginary center line D. The second inner track 55 may cross with the imaginary center line D.

In some implementations, the plurality of inner bridges 62 and 63 may connect the plurality of inner tracks 54 and 55 with each other in series in the flow direction of the current.

A plurality of inner bridges 62 and 63 may be spaced apart from each other.

The inner bridges 62 and 63 may be smaller than the outer bridges 32 and 33.

The widths of the inner bridges 62 and 63 may be equal to the widths W2 of the inner tracks 54 and 55. However, the present disclosure is not limited thereto. For example, the widths of the inner bridges 62 and 63 may be narrower than the widths W2 of the inner tracks 54 and 55.

The plurality of inner bridges 62 and 63 may include a first inner bridge 62 and a second inner bridge 63.

In some implementations, the first inner bridge 62 may connect outer ends of the adjacent inner tracks 54 and 55 with each other. In some implementations, the second inner bridges 63 may connect inner ends of the adjacent inner tracks 54 and 55 with each other.

The outer end of each of the inner tracks 54 and 55 may be closer to the first imaginary circle CI of the first imaginary circle CI and the imaginary center line D. The inner end of each of the inner tracks 54 and 55 may be closer to the imaginary center line D of the first imaginary circle CI and the imaginary center line D.

The first inner bridge 62 and the second inner bridge 63 may be alternately arranged in the second direction.

The first inner bridge 62 may have a curved shape. In more detail, the first inner bridge 62 may have an arc shape. The first inner bridge 62 may be curved while protruding toward the first imaginary circle CI in the first direction.

The second inner bridge 63 may have a curved shape. In more detail, the second inner bridge 63 may have an arc shape. The second inner bridge 63 may be curved while protruding toward the imaginary center line D in the first direction.

The first inner bridge 62 may be spaced apart from the second outer bridge 33.

The starting point of the inner pattern parts 54, 55, 62, and 63 may be positioned at an end of one first inner track 54 and the ending point of the inner pattern parts 54, 55, 62, and 63 may be positioned at an end of an opposite first inner track 54. In other words, the pair of second electrode parts 69 may be connected with the one first inner track 54 and the opposite first inner track 54, respectively.

In some implementations, at least some of the plurality of inner tracks 54 and 55 may be longer than the outer track 31 In more detail, at least some of the plurality of inner tracks 54, and 55 may be formed to be longer than the longest outer track 31 among the plurality of outer tracks 31.

In addition, the number of inner tracks 54 and 55, which are longer than the outer track 31, among the plurality of inner tracks 54, and 55 is greater than the number of the inner tracks 54 and 55, which is shorter than the outer track 31, among the inner track 54 and 55 For example, as illustrated in FIG. 6, the number of the inner tracks 54 and 55 that are longer than the outer track 31 may be 21, and the number of the inner tracks 54 and 55 that are shorter than the outer track 31 may be six.

Figure 7:
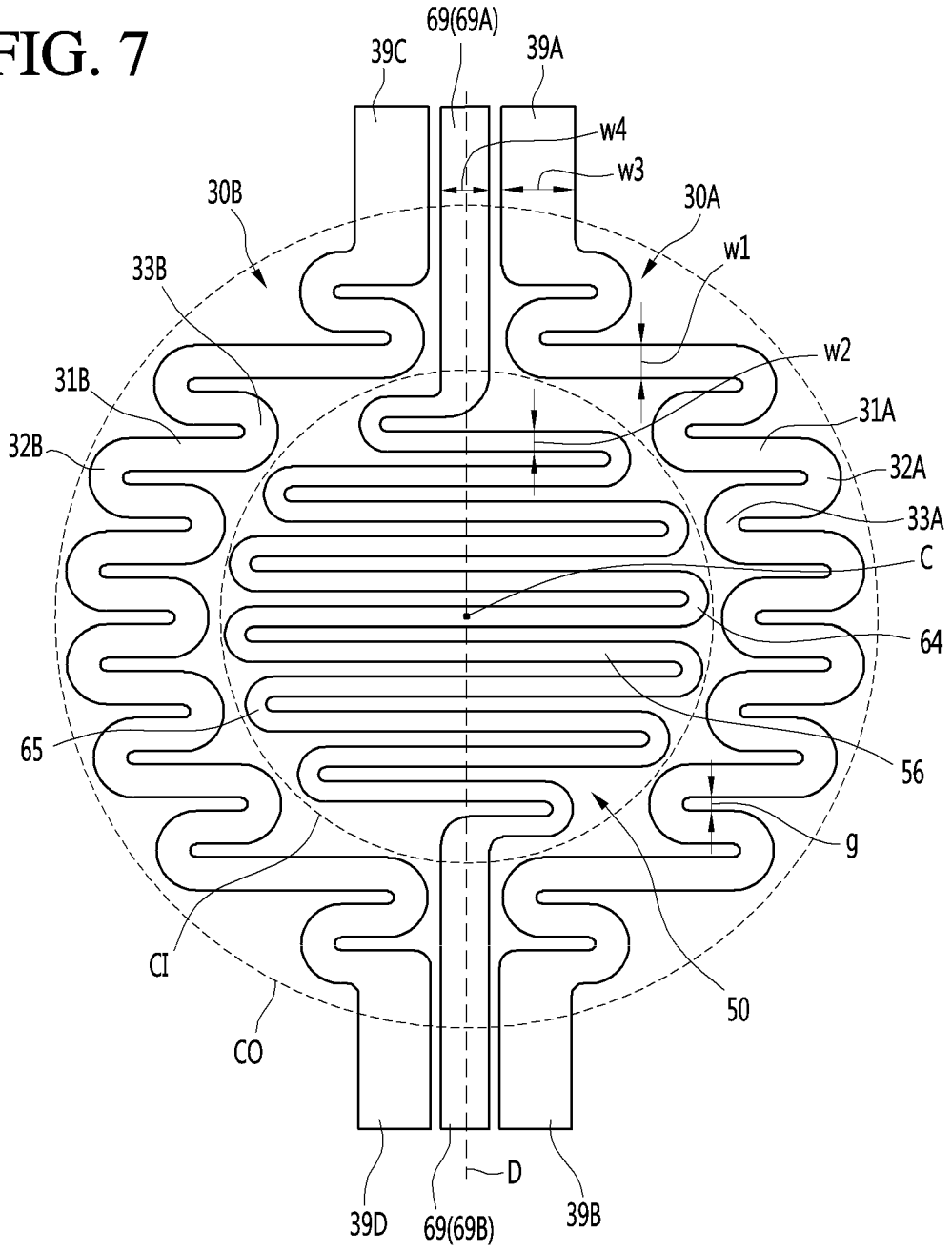
FIG. 7 is a bottom view illustrating an example of an electric heater.

FIG. 7 is a bottom view illustrating an example of an electric heater.

Hereinafter, the redundant repeat of the first implementation described above will be omitted, and the following description will be made while focusing on the difference.

The electric heater according to the present implementation may include a first outer plane heating element 30A, a second outer plane heating element 30B, and an inner plane heating element 50.

The first outer plane heating element 30A and the second outer plane heating element 30B may be positioned outside the inner plane heating element 50.

The first outer plane heating element 30A may include first-first outer pattern parts 31A, 32A, and 33A, first electrode parts 39A and 39B connected with the first-first outer pattern parts 31A, 32A, and 33A. The second outer plane heating element 30B may include second outer pattern parts 31B, 32B, and 33B and second electrode parts 39C and 39D connected with the second outer pattern parts 31B, 32B, and 33B.

The following description will be made while focusing on the first outer plane heating element 30A.

The starting point and the ending point of the first outer pattern parts 31A, 32A, and 33A may be connected with each other. According to the present implementation, the starting and ending points of the first outer pattern parts 31A, 32A, and 33A may refer to parts, which are connected with a pair of first electrode parts 39A and 39B, among the first outer pattern parts 31A, 32A, and 33A.

The first outer pattern parts 31A, 32A, and 33A may be interposed between the first imaginary circle CI and the second imaginary circle CO.

The first outer pattern parts 31A, 32A, and 33A may include a plurality of outer tracks 31A and a plurality of outer bridges 32A and 33A for connecting the plurality of outer tracks 31A with each other in series.

Each outer track 31A may have a straight line shape. The straight line shape may be a bar shape.

In more detail, each outer track 31A may extend in one direction. The one direction may be a direction perpendicular to the imaginary center line D extending across the inner plane heating element 50, but is not limited thereto Hereinafter, the longitudinal direction of the outer track 31A will be referred to as a first direction (a left-right direction in FIG. 7) and the direction perpendicular to the first direction will be referred to as a second direction (an up-down direction in FIG. 7).

At least some of the plurality of outer tracks 31A may have different lengths. The plurality of outer tracks 31A may have equal widths W1.

The plurality of outer tracks 31A may be spaced apart from each other. In more detail, the plurality of outer tracks 31A may be spaced apart from each other in the second direction.

In some implementations, the plurality of outer bridges 32A and 33A may connect the plurality of outer tracks 31A in series in a flow direction of a current.

The plurality of outer bridges 32A and 33A may be spaced apart from each other.

The widths of the outer bridges 32A and 33A may be equal to the width W1 of the outer track 31A. However, the present disclosure is not limited thereto. For example, the widths of the outer bridges 32A and 33A may be formed to be narrower than the width W1 of the outer track 31A.

The plurality of outer bridges 32A and 33A may include a first outer bridge 32A and a second outer bridge 33A.

Each of the first outer bridges 32A may connect outer ends of the adjacent outer tracks 31A with each other. The second outer bridges 33A may connect inner ends of the adjacent outer tracks 31A with each other. The outer end of each outer track 31A may be closer to the second imaginary circle CO of the first imaginary circle CI and the second imaginary circle CO. The inner end of each outer track 31A may be closer to the first imaginary circle CI of the first imaginary circle CI and the second imaginary circle CO.

The first outer bridge 32A may have a curved shape. In more detail, the first outer bridge 32A may have an arc shape. The first outer bridge 32A may be curved while protruding toward the second imaginary circle CO in the first direction.

The second outer bridge 33A may have a curved shape. In more detail, the second outer bridge 33A may have an arc shape. The second outer bridge 33A may be curved while protruding toward the first imaginary circle CI in the first direction.

The second outer bridges 33A may be spaced apart from the inner pattern parts 56, 64, and 65. In more detail, the second outer bridge 33A may be spaced apart from the first inner bridge 64.

The distance between the second outer bridges 33A adjacent to each other may be shorter than the distance between the first outer bridges 32A adjacent to each other.

In some implementations, the pair of first electrode parts 39 may include a positive electrode part 39A and a negative electrode part 39B. One of the positive electrode part 39A and the negative electrode part 39B may be connected with the starting point of the first outer pattern parts 31A, 32A, and 33A and a remaining one may be connected with the ending point of the first outer pattern parts 31A, 32A, and 33A, respectively.

The starting point of the first outer pattern parts 31A, 32A, and 33A may be positioned at an end of one outer track 31A and the ending point of the first outer pattern parts 31A, 32A, and 33A may be positioned at an end of another outer track 31A which is farthest away from the one outer track 31A. In other words, the pair of first electrode parts 39A and 39B may be connected with the ends of the one outer track 31A and the another outer track 31A, respectively.

In this case, the positive electrode part 39A and the negative electrode part 39B are positioned opposite to each other about the inner pattern parts 56, 64, 65 or the first imaginary circle CI, in the second direction.

In some implementations, the second outer plane heating element 30B may be symmetrical to the first outer plane heating element 30A about the imaginary center line D extending across the inner plane heating element 50. Here, the imaginary center line D may be an imaginary straight line passing through the center C of the inner plane heating element 50.

In more detail, the first outer plane heating element 30A and the second outer plane heating element 30B may have a shape symmetrical to each other about the imaginary center line D. In addition, the first outer plane heating element 30A and the second outer plane heating element 30B may be positioned opposite to each other.

Therefore, a person skilled in the art may easily understand the configuration of the second outer plane heating element 30B from the configuration of the first outer plane heating element 30A described above.

However, the configuration of the second outer plane heating element 30B is not limited thereto. For example, the second outer pattern parts 31B, 32B and 33B of the second outer plane heating element 30B may have the configuration corresponding to the second outer pattern part H2 (see FIG. 4) described in the first implementation, instead of the configuration symmetrical to the first outer pattern parts 31A, 32A, and 33A.

In some implementations, the inner plane heating element 50 may be positioned inside the first outer plane heating element 30A and the second outer plane heating element 30B. The inner plane heating element 50 may generate heat independently from the first outer plane heating element 30A and the second outer plane heating element 30B. The inner plane heating element 50 may be spaced apart from the first outer plane heating element 30A and the second outer plane heating element 30B.

The electric heater 1 may be controlled in a single heating mode in which a current is applied to only one of the first outer plane heating element 30A, the second outer plane heating element 30B, and the inner plane heating element 50. The electric heater 1 may be controlled in a dual heating mode in which a current is applied to only any two of the first outer plane heating element 30A, the second outer plane heating element 30B, and the inner plane heating element 50. The electric heater 1 may be controlled in a triple heating mode in which a current is applied to all the first outer plane heating element 30A, the second outer plane heating element 30B, and the inner plane heating element 50.

In some implementations, the inner plane heating element 50 may include inner pattern parts 56, 64, and 65, and third electrode parts 69 connected with the inner pattern parts 56, 64, and 65.

The inner pattern parts 56, 64, and 65 may connect the starting point and the ending point thereof. In some examples, the starting point and the ending point of the inner pattern parts 56, 64, and 65 may refer to parts, which are connected with a pair of third electrode parts 69, of the inner pattern parts 56, 64, and 65.

The inner pattern parts 56, 64, and 65 may be positioned inside the first imaginary circle CI.

The inner pattern parts 56, 64, and 65 have a plurality of inner tracks 56 formed in parallel to each other and a plurality of inner bridges 64 and 65 connecting the plurality of inner tracks 56 in series The inner track 56 may have a straight line shape. The straight line shape may be a bar shape.

In more detail, the inner track 56 may extend in one direction. The following description will be made regarding that the one direction is parallel to the first direction by way of example. In other words, the inner track 56 and the outer track 31A may be formed to extend in directions parallel to each other.

The plurality of inner tracks 56 may be spaced apart from each other. In more detail, the plurality of inner tracks 56 may be spaced apart from each other in a direction perpendicular to the lengthwise direction of the inner track 56.

At least some of the plurality of inner tracks 56 may have different lengths. The length of each of the plurality of inner tracks 56 may be longer as the plurality of inner tracks 56 are closer to the center C of the inner plane heating element 50 in the second direction.

In some implementations, the plurality of inner bridges 64 and 65 may connect the plurality of inner tracks 56 with each other in series in the flow direction of the current.

A plurality of inner bridges 64 and 65 may be spaced apart from each other.

The inner bridges 64 and 65 may be smaller than the outer bridges 32A and 33A.

The plurality of inner bridges 64 and 65 may include a first inner bridge 64 and a second inner bridge 65.

Each of the first inner bridges 64 may connect one ends of the adjacent inner tracks 56 with each other. The second inner bridges 65 may connect inner opposite ends of the adjacent inner tracks 56 with each other.

One end of each of the inner tracks 54 and 55 may be closer to the first outer pattern parts 31A, 32A, and 33A of the first outer pattern parts 31A, 32A, and 33A and the second outer pattern parts 31B, 32B, and 33B. Opposite end of each of the inner tracks 54 and 55 may be closer to the second outer pattern parts 31B, 32B, and 33B of the first outer pattern parts 31A, 32A, and 33A and the second outer pattern parts 31B, 32B, and 33B.

The first inner bridge 64 and the second inner bridge 65 may be alternately arranged in the second direction.

The first inner bridge 64 may have a curved shape. In more detail, the first inner bridge 64 may have an arc shape. The first inner bridge 64 may be curved while protruding toward the first outer pattern parts 31A, 32A, and 33A in the first direction.

The second inner bridge 65 may have a curved shape. In more detail, the second inner bridge 65 may have an arc shape. The second inner bridge 65 may be curved while protruding toward the second outer pattern parts 31B, 32B, and 33B in the first direction.

The first inner bridge 64 may be spaced apart from the second inner bridge 65.

In some implementations, the starting point of the inner pattern parts 56, 64, and 65 may be positioned at an end of one inner track 56, and the ending point of the inner pattern parts 56, 64, and 65 may be positioned at an opposite end of the inner track 56, which is furthest apart from the one inner track 56. In other words, a pair of third electrode parts 69 may be connected with the one first inner track 54 and the opposite first inner track 54, respectively.

The pair of third electrode parts 69 may include a positive electrode part 69A and a negative electrode part 69B. The pair of third electrode parts 69 may be positioned opposite to each other about the center C of the inner plane heating element 50.

For example, at least a portion of the positive electrode part 69A of the third electrode part 69 may be interposed between the positive electrode part 39A of the first electrode part and the positive electrode part 39C of the second electrode part. In addition, at least a portion of the negative electrode part 69B of the third electrode part 69 may be interposed between the negative electrode part 39B of the first electrode part and the negative electrode part 39D of the second electrode part.

In some implementations, at least some of the plurality of inner tracks 56 may be longer than the outer track 31A. In more detail, at least some of the plurality of inner tracks 56 may be formed to be longer than the outer track 31A, which is longest, of the plurality of outer tracks 31A.

The number of the inner tracks 56, which is longer than the outer tracks 31A, of the plurality of inner tracks 56 is larger than the number of the inner tracks 56, which is shorter than the outer tracks 31A, of the plurality of inner tracks 56. For example, as illustrated in FIG. 7, the number of inner tracks 56, which is longer than the longest outer track 31A, may be 11, and the number of inner tracks 56, which is shorter than the longest outer track 31A, may be two.

While the present disclosure has been described with reference to exemplary implementations, it will be apparent to those skilled in the art that various changes and modifications may be made without departing from the spirit and scope of the present disclosure.

Therefore, the exemplary implementations of the present disclosure are provided to explain the spirit and scope of the present disclosure, but not to limit them, so that the spirit and scope of the present disclosure is not limited by the implementations.

The scope of the present disclosure should be construed on the basis of the accompanying claims, and all the technical ideas within the scope equivalent to the claims should be included in the scope of the present disclosure.

What is claimed is:

1. An electric heater configured to be installed at an electric range, the electric heater comprising:

a substrate;

an inner pattern part that is disposed at a surface of the substrate, the inner pattern part having an inner starting point and an inner ending point that are connected to each other;

a first outer pattern part that is disposed at the surface of the substrate, that is positioned outside the inner pattern part, and that is spaced apart from the inner pattern part, the first outer pattern part having a first starting point and a first ending point that are connected to each other; and a second outer pattern part that is positioned outside the inner pattern part and that is symmetrical to the first outer pattern part with respect to a first center line extending across the inner pattern part, the second outer pattern part having a second starting point and a second ending point that are connected to each other, wherein the inner pattern part includes:

a plurality of inner tracks spaced apart from each other, and a plurality of inner bridges that connect the plurality of inner tracks to each other in series, wherein the first outer pattern part includes:

a plurality of outer tracks spaced apart from each other, and a plurality of outer bridges that connect the plurality of outer tracks to each other in series, wherein each of the plurality of inner tracks and each of the plurality of outer tracks have a linear shape, and wherein the plurality of inner tracks include:

a first number of inner tracks having a length that is longer than a length of each of the plurality of outer tracks, and a second number of inner tracks having a length that is shorter than the length of each of the plurality of outer tracks, the first number being greater than the second number.

2. The electric heater of claim 1, wherein the inner pattern part is positioned inside a first imaginary circle, and wherein the first and second outer pattern parts are interposed between the first imaginary circle and a second imaginary circle that is concentric with the first imaginary circle, and wherein a diameter of the second imaginary circle is greater than a diameter of the first imaginary circle.

3. The electric heater of claim 1, wherein a width of each of the first and second outer pattern parts along the surface of the substrate is different from a width of the inner pattern part along the surface of the substrate.

4. The electric heater of claim 1, wherein each of the plurality of inner tracks has an arc shape, and wherein each of the plurality of outer tracks has a linear shape.

5. The electric heater of claim 1, wherein each of the plurality of outer tracks extends in a radial direction of the outer pattern part.

6. The electric heater of claim 1, wherein the plurality of outer tracks extend parallel to each other.

7. The electric heater of claim 1, wherein each of the plurality of outer tracks has an inner end facing the plurality of inner tracks and an outer end disposed outward of the inner end, wherein the electric heater further comprises:

a pair of first electrode parts connected to the outer pattern part; and a pair of second electrode parts connected to the inner pattern part, and wherein each of the pair of first electrode parts is connected to the outer end or the inner end of one of the plurality of outer tracks.

8. The electric heater of claim 7, wherein the plurality of outer bridges include:

a first outer bridge that connects the outer ends of adjacent outer tracks of the plurality of outer tracks to each other; and a second outer bridge that connects the inner ends of adjacent outer tracks of the plurality of outer tracks to each other.

9. The electric heater of claim 8, wherein the first outer bridge and the second outer bridge are arranged alternately along a circumferential direction of the outer pattern part.

10. The electric heater of claim 8, wherein the first outer bridge has a curved shape that protrudes outward to the outer end, and wherein the second outer bridge has a curved shape that protrudes inward to the inner end.

11. The electric heater of claim 8, wherein a length of the first outer bridge between the outer ends of the adjacent outer tracks is greater than a length of the second outer bridge between the inner ends of the adjacent outer tracks.

12. The electric heater of claim 1, wherein the plurality of inner tracks include:

an outermost inner track;

an innermost inner track positioned radially inside the outermost inner track; and an intermediate inner track interposed between the outermost inner track and the innermost inner track, and wherein the outermost inner track, the innermost inner track, and the intermediate inner track have concentric arc shapes.

13. The electric heater of claim 1, wherein the plurality of inner tracks include:

a first inner track that is disposed at a first side or a second side opposite to the first side with respect to an imaginary center line passing through a center of the inner pattern part; and a second inner track that crosses the imaginary center line and extends between the first side and the second side, and wherein the first inner track and the second inner track extend parallel to each other.

14. The electric heater of claim 1, wherein the plurality of inner tracks extend parallel to each other and cross an imaginary center line passing through a center of the inner pattern part.

15. The electric heater of claim 1, wherein each of the plurality of outer tracks and each of the plurality of the inner tracks extend parallel to each other.

16. The electric heater of claim 1, further comprising:

a pair of first electrode parts that are connected to the first starting point and the first ending point of the first outer pattern part, respectively, the first starting point and the first ending point being located symmetrical with respect to a second center line perpendicular to the first center line;

a pair of second electrode parts that are connected to the second starting point and the second ending point of the second outer pattern part, respectively, the second starting point and the second ending point being located symmetrical with respect to the second center line; and a pair of third electrode parts that are connected to the inner starting point and the inner ending point of the inner pattern part, respectively, the inner starting point and the inner ending point being located symmetrical with respect to the second center line.

17. An electric heater configured to be installed at an electric range, the electric heater comprising:

a substrate;

an inner pattern part disposed at a surface of the substrate;

a first outer pattern part disposed at the surface of the substrate and positioned outside the inner pattern part; and a second outer pattern part that is positioned outside the inner pattern part and that is symmetrical to the first outer pattern part about a first center line extending across the inner pattern part, wherein the inner pattern part includes:

a plurality of inner tracks spaced apart from each other, and a plurality of inner bridges that connect the plurality of inner tracks to each other in series, wherein the first outer pattern part includes:

a plurality of outer tracks spaced apart from each other, and a plurality of outer bridges that connect the plurality of outer tracks to each other, wherein each of the plurality of inner tracks and each of the plurality of outer tracks have a linear shape, and wherein the plurality of inner tracks include:

a first number of inner tracks having a length that is longer than a length of each of the plurality of outer tracks, and a second number of inner tracks having a length that is shorter than the length of each of the plurality of outer tracks, the first number being greater than the second number.

18. The electric heater of claim 17, wherein the inner pattern part has an inner starting point and an inner ending point that are connected to each other and located symmetrical with respect to a second center line perpendicular to the first center line, wherein the first outer pattern part has a first starting point and a first ending point that are connected to each other and located symmetrical with respect to the second center line, and wherein the second outer pattern part has a second starting point and a second ending point that are connected to each other and located symmetrical with respect to the second center line.

19. The electric heater of claim 18, further comprising:

a pair of first electrode parts that are connected to the first starting point and the first ending point of the first outer pattern part, respectively;

a pair of second electrode parts that are connected to the second starting point and the second ending point of the second outer pattern part, respectively; and a pair of third electrode parts that are connected to the inner starting point and the inner ending point of the inner pattern part, respectively, wherein the first starting point and the second starting point are spaced apart from each other and located symmetrical with respect to the first center line, wherein the first ending point and the second ending point are spaced apart from each other and located symmetrical with respect to the first center line, and wherein the first center line passes through the pair of third electrode parts.

* * * * *